US006318625B1

(12) United States Patent
Muller et al.

(10) Patent No.: US 6,318,625 B1
(45) Date of Patent: Nov. 20, 2001

(54) PACKAGING WRAPPER

(75) Inventors: Heinz-Jurgen Muller, Lampertheim; Wolfgang Malke, Carlsberg, both of (DE)

(73) Assignee: SCA Hygiene Products GmbH, Mannheim (DE)

( * ) Notice: Subject to any disclaimer, the term of this patent is extended or adjusted under 35 U.S.C. 154(b) by 0 days.

(21) Appl. No.: 09/378,007

(22) Filed: Aug. 19, 1999

Related U.S. Application Data

(63) Continuation of application No. PCT/EP98/00766, filed on Feb. 11, 1998.

(51) Int. Cl.[7] ..... B65D 65/28
(52) U.S. Cl. ..... 229/87.05
(58) Field of Search ..... 383/98, 99, 203, 383/210, 211; 206/494; 229/87.05

(56) References Cited

U.S. PATENT DOCUMENTS

| | | | | |
|---|---|---|---|---|
| 2,318,101 | * | 5/1943 | Rose | 229/87.05 X |
| 2,690,288 | * | 9/1954 | Allen et al. | 229/212 |
| 4,540,091 | | 9/1985 | Haböck . | |
| 5,040,685 | | 8/1991 | Focke et al. . | |
| 5,085,724 | * | 2/1992 | Focke et al. | 156/256 |
| 5,096,113 | * | 3/1992 | Focke | 229/87.05 |
| 5,121,879 | * | 6/1992 | Focke et al. | 229/87.05 X |
| 5,165,545 | | 11/1992 | Focke et al. . | |

FOREIGN PATENT DOCUMENTS

| | | |
|---|---|---|
| 2015746 | 11/1990 | (CA) . |
| 2018224 | 12/1990 | (CA) . |
| 90 10 670.9 | 10/1990 | (DE) . |
| 90 14 065.6 | 4/1991 | (DE) . |
| 41 21 914 | 1/1992 | (DE) . |
| 0 132 250 | 1/1985 | (EP) . |
| 0 298 360 | 11/1988 | (EP) . |
| 0 401 621 | 12/1990 | (EP) . |

* cited by examiner

*Primary Examiner*—Jes F. Pascua
(74) *Attorney, Agent, or Firm*—Fitch, Even, Tabin & Flannery

(57) ABSTRACT

The invention relates to a packaging wrapper, particularly for paper handkerchiefs. This packaging wrapper is characterized in that only the material (6, 7) overlapping in the edge areas of the upper side (O) is bonded together by heat effect. In the remaining area, there is, on the inner side of the flap (5), a pressure-sensitive adhesive which sticks to the extension (2) of the front side (V), when the opening for removing the contents is closed. As a result of this, the flap, when closed, lies almost completely on the upper side of the packaging wrapper, and the bonding does not spoil the appearance of the upper side of the packaging wrapper.

35 Claims, 1 Drawing Sheet

0
6'
6
4
7
7'
1
5
R
4
6
6'
9
2
1
7'
7
V 11
8
12
10
6'
6
5
7'
3
6
7
2
6'
13
7
7'
V

PACKAGING WRAPPER

This application is a continuation of PCT/EP98/00766 filed Feb. 11, 1998.

The invention relates to a packaging wrapper for handkerchiefs, household or other hygiene tissues, as a pouch comprising a sealing flap that the least partially overlaps an opening for removing the tissues, this opening being formed on an elongated upper side of the packaging wrapper, and which also at least partially overlaps an extension of the front side of the packaging wrapper on the upper side, this extension at least partially covering the removal opening. The sealing flap is formed by an extension of the rear side of the pouch and by slots that are located on both sides and within an edge of the upper side, whereby the extension of the front side of the packaging wrapper overlapped by the sealing flap is also formed by slots located on both sides and within the edge of the upper side in such a way that the slots simultaneously delimit the removal opening, and whereby an overlapping material of the packaging wrapper is bonded together on the upper side outside the slots and also outside the removal opening.

BACKGROUND

Such packaging wrappers or paper handkerchiefs are commercially available in a variety of versions and they are all provided with a removal opening that can be closed by means of a sealing flop, whereby an adhesive strip located on the sealing flap and containing a pressure-sensitive adhesive makes it possible to open and close the removal opening repeatably. In this way, a packaging wrapper is also known which in broadside form is to be opened on the long narrow side and in which an extension of the rear side as a sealing flap covers a removal opening. An extension of the front side also partially covers the removal opening on the narrow upper side of the packaging wrapper. These extensions are formed by slots which are inwardly spaced apart from the narrow edge of the upper side and extend transverse to the longitudinal extension of the upper side. The region of the upper side outside the removal opening and hence outside the slots is closed as a result of bonding.

Provision of slots in the extensions of the front and rear sides of the packaging wrapper—which extensions bridge over the removal opening and guarantee engagement with the packing wrapper, thus ensuring that the tissues are removed more easily from the packaging wrapper—nevertheless entails the problem that packaging—wrapper corners formed by the slots project outwards. On the one hand, this results in an impaired appearance. On the other hand; it is not always possible to prevent the penetration of dirt in the area of the removal opening, particularly after the sealing flap has been opened and closed frequently.

Although U.S. Pat. No. 5,040,685 does mention the provision of a connection of the sealing flap at the upper side of, a packaging wrapper, this connection only serves to guarantee that the pack is sealed prior to being opened for the first time.

In the packaging wrapper for paper handkerchiefs shown in DE-Ul-90 14 065, an adhesive strip which sticks to the front side of the packaging wrapper in order to close the sealing flap serves to open and reseal the packaging wrapper.

The skilled person gathers the teaching from DE-Ul-90 10 670 that a strip of pressure-sensitive adhesive should be placed between the sealing flap and the extension of the front side of the packaging wrapper. A region which is free of pressure-sensitive adhesive and which is consequently not bonded to the extension of the front side of the packaging wrapper is formed between the strip of pressure-sensitive adhesive and the end edge of the sealing flap. As a result a non-adhesive section which does not make contact with the extension of the front side is produced as a grip tab at this site.

EP-A-0 293 360 envisages the formation of a convexly extending edge on a film section that overlaps the removal opening of the packaging wrapper in the central region of this edge. This packaging wrapper design is characterized by the fact that it automatically places the sealing flap over the removal opening and covers this opening whenever the wrapper contains handkerchiefs, thus causing them to lie protected within the film wrapper.

In the packaging wrapper described in EP-A-0 132 250, the overlapping film sections -can be fixed together at the shorter edges of the elongated narrow sides by means of a bonding connection for one-off sealing.

SUMMARY

Starting out from this prior art, the present invention is based upon, the object of extending known packaging wrappers such that even better handling is achievable in conjunction with an improved appearance.

In combination with the features described at the start, this object is solved by applying A pressure-sensitive adhesive for temporarily and repeatably closing the pouch on the aforementioned extension's outer surface located beneath the sealing flap or on the sealing flap's inner surface located above the extension such that corners formed by the slots do not outwardly project in the closed state.

As a result, of the fact that a pressure-sensitive adhesive for temporarily and repeatably closing the pouch is located between the sealing flap and the front-side extension, the sealing flap, in its closed state, always makes contact with the, front-side extension even after the flap has been repeatedly opened. The corners formed by the slots in the front-side and rear-side extensions therefore no longer outwardly project, thus improving the appearance of the packaging wrapper. An especially simple seal is also achieved particularly by the combination of the slots arranged in the extensions with the pressure-sensitive adhesive in the area between the extensions, thereby making handling easier while improving the appearance.

In the case of the packaging wrapper of EP 0 401 621 A, there is no pressure-sensitive adhesive between the extension 17 and the sealing flap 23.

By bonding-only outside the slots on the upper side of the packaging wrapper, the remaining area of the upper side remains unaffected by the effect of heat, thus improving the appearance of the packaging wrapper.

Since printing on the outer surface of the packaging wrapper prevents the film from bonding, there are-regions without print on the upper side outside the slots and outside the removal opening in the area of bonding; these regions allow the material to be bonded.

An adhesive strip fastened to the sealing flap can also be attached, as an actual mount for the sealing flap; this adhesive strip is provided with a pressure-sensitive adhesive and sticks to the front side of the packaging wrapper in order to close the sealing flap.

Depending on the desired conditions, the adhesive force can be controlled via the aforementioned pressure- sensitive adhesive applied in the area of the upper side of the packaging wrapper whenever this pressure-sensitive adhesive is applied either over the entire surface area or in the form of stripes, dots or other patterns.

Depending on the desired conditions, the adhesive force can be controlled via the aforementioned pressure-sensitive adhesive applied in the area of the upper side of the packaging wrapper whenever this pressure-sensitive adhesive is applied either over the entire surface area or in the form of stripes, dots or other patterns.

To prevent the film from initially tearing in the area of the adhesive strip when opening the sealing flap, the area covered by the pressure-sensitive adhesive is reduced in the vicinity of the adhesive strip. In particular, the reduced area is concavely rounded toward the free edge of the sealing flap, i.e. from where the adhesive strip engages.

BRIEF DESCRIPTION OF THE DRAWINGS

The invention will be explained in more detail below on the basis of an exemplary embodiment illustrated purely diagrammatically in the drawings.

DETAILED DESCRIPTION

Figure 1:
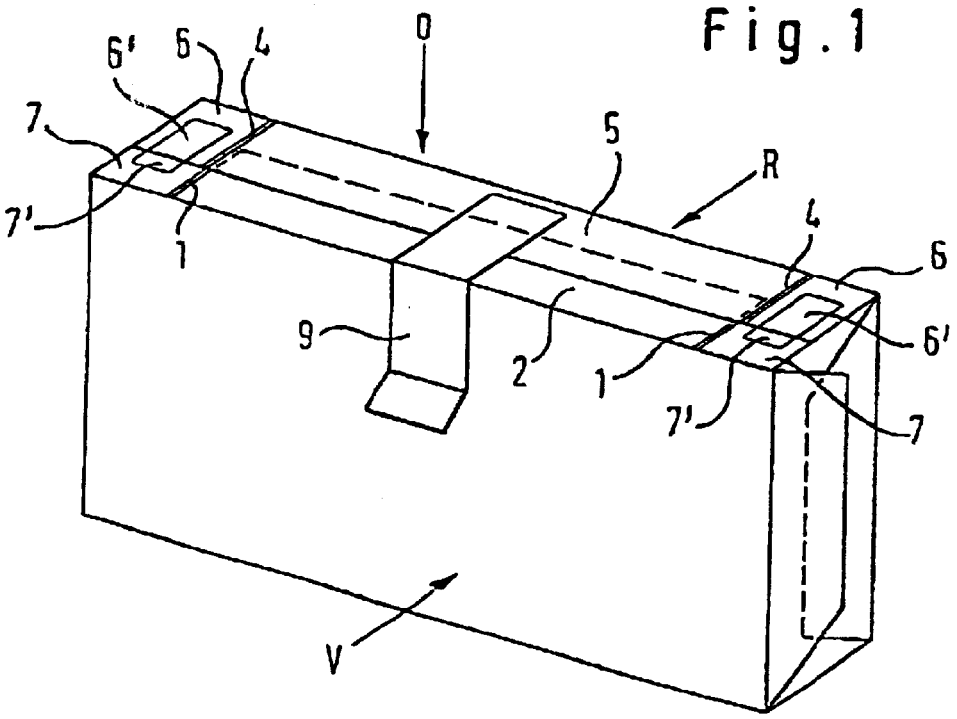
FIG. 1 shows a perspective view of a closed packaging wrapper for paper handkerchiefs in broadside form.

The packaging wrapper illustrated in the drawings is preferably made from a polyethylene film. It forms, inter alia a rectangular, elongated upper side O, a larger rear side R and a front side V, the sides being preferably printed in color and with motifs, patterns and lettering. It should be mentioned straight Away that such printing prevents areas of film from bonding.

The polyethylene film is produced and printed as continuous sheeting and then cut into such sections that the illustrated packaging wrapper can be formed therefrom. An area of film is created by slots 1; this area later acts as an extension 2 of the front side V and, from this sole, at: least partially closes the removal opening 3 identifiable in FIG. 2. Slots 4 form a sealing flap 5 which in its closed state is partially located on the outside of the extension 2 and completely closes the removal opening 3. In the longitudinal direction outside the sealing flap, the slots 1 and 4 form film tabs 6 and 7 in the edge regions of the upper side 0; these tabs are bonded together by the effect of heat. To make this bonding possible despite the presence of printing, blank windows 6' and 7' are located in the film tabs 6 and 7.

A pressure-sensitive adhesive or a light permanent adhesive which enables the sealing flap 5, to be repeatably and temporarily stuck to the outside of the extension 2 is applied to the inside of the sealing flap 5 in a region 8. An adhesive strip 9 that is also provided with a pressure-sensitive adhesive on the inner side 10 is attached to the outside of the sealing flap 5, whereby a grip area 11 is free of pressure-sensitive adhesive and can be taken hold of at any time. A concavely rounded region 12 without pressure-sensitive, adhesive is provided in the area of this adhesive strip on the inside of the sealing flap S. In the region 8, the pressure-sensitive adhesive can be provided in the form of one or more stripes or in the form of a few or a plurality of dots or in the form of another pattern. It should in any case be ensured that, in the closed-state of the pouch, the region 8 is designed such as to be supported only in the area of the extension 2 in order that the adhesive cannot come into contact with the contents of the pouch.

A heat-sealing lacquer can also be applied to the region 8; such a lacquer effects adherence to the extension 2 whenever heat is applied to this area of the film during closure of the pouch. By means of this region 8, the sealing flap 5 therefore sticks to the extension 2. If the pouch is opened, the connection via the sealing lacquer is released without the occurrence of re-adherence when sealing the pouch. As a heat-sealing lacquer, it is possible to use one such as that bearing the designation XE 2470 of the Swale AG company based in 8153 Rumlang in Switzerland. This heat-sealing lacquer was developed for application on aluminum film, paper, polypropylene and polyethylene films for sealing polyethylene films and polystyrene and PVC.

Figure 2:
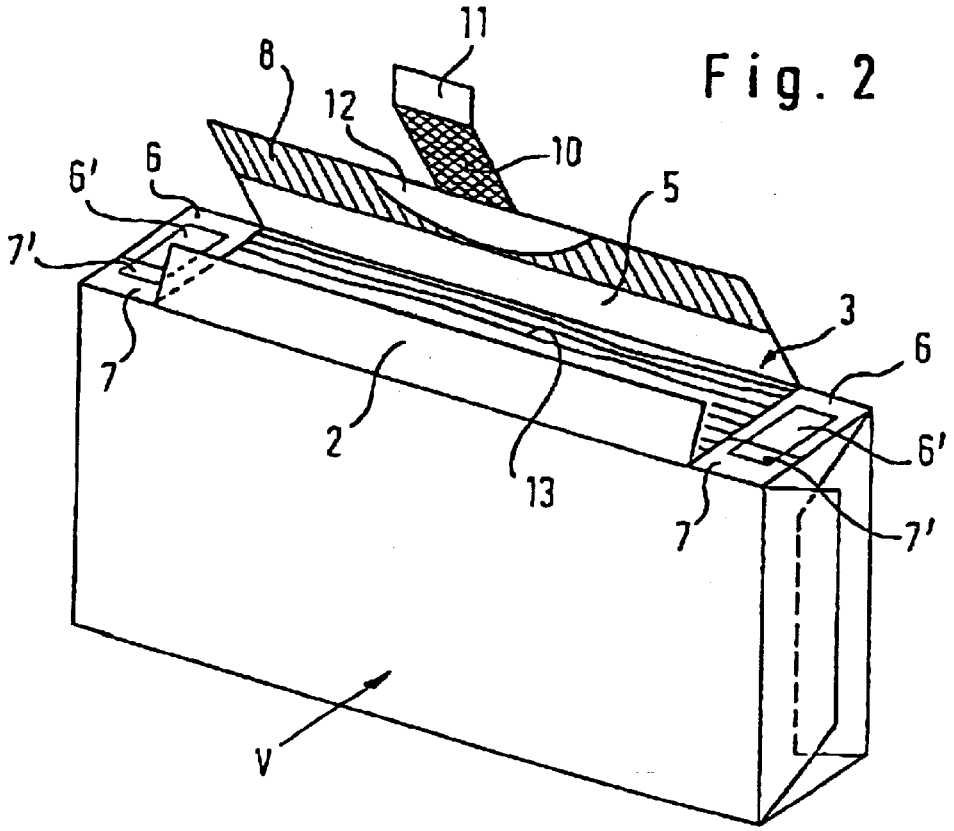
FIG. 2 shows a perspective illustration of the packaging wrapper according to FIG. 1 in the opened state.

In FIG. 2, part of the handkerchiefs 13 packed within the wrapper is visible through the removal opening 3.

Examples of possible pressure-sensitive adhesives include the following commercially available adhesives: Adhesin A 6723, Adhesin J 1422-21. Adhesin J 1620, Technomelt Q 5422, Technomelt Q 5427-21, Technomelt Q 5430 and Technomelt Q 8407-24 offered by the German company Henkel; Dorus PS 578 S offered by the German company Dr. Rudolf Schieber Chlemische Fabrik GbmH + Co. KG in 73438 Bopfingen and DURO-TAK 280-1151 and DURO-TAK H 1525 of the German company National Starch & Chemical GmbH in 67435 Neustadt.

Adhesin J 1422-21 exhibits good cohesion and high surface tack. The adhesive is characterized by particularly good resistance to aging. Adhesin J 1422-21 is a highly concentrated, quick setting acrylate-based adhesive dispersion. The same applies to Adhesin J 1620 with the addition that it is well suited to high-speed machinery. The adhesive has excellent spray properties. Technomelt Q 5422 is a white, transparent surface-tacky synthetic-based hot-melt adhesive. Technomelt Q 5422 is suitable both for punctiform and striped application and for spray application. Technomelt Q 5427-21 is a colorless synthetic-based hot-melt adhesive suitable both for punctiform and striped application and for spray application. This is also true of Technomelt Q 5430 and Technomelt Q 8407-24 which is a pressure-sensitive hot-melt adhesive with good properties of adhesion to a wide variety of materials. Adhesion to paper is reduced, thus making Technomelt Q 8407-24 suitable in a particularly beneficial manner for re-detachable adherence. Dorus PS 578 S is a pressure-sensitive hot-melt adhesive that can be particularly applied in the spinning spray technique or by means of nozzles and rolls. DURO-TAY, 280-1151 comprises the following constituents: more than 50% ethyl acetate, 1–<5% n-hexane and 1–<5% 2-ethyl hexyl acrylate. The adhesive is colorless. DURO-TAK H 1525 is a hot-melt adhesive.

What is claimed is:

1. A packaging wrapper for handkerchiefs, household or other hygiene tissues, the packaging wrapper configured as a pouch comprising:

a sealing flap which at least partially overlaps an opening for removing the handkerchiefs, household or other hygiene tissues, said opening being formed on an elongated upper side of said packaging wrapper, the sealing flap at least partially overlapping an extension of a front side of said packaging wrapper on the elongated upper side, said sealing flap being formed by an extension of a rear side of the pouch and by slots located on both sides and within an edge of the upper side, said extension at least partially covering said removal opening, said extension of the front side of said packaging wrapper overlapped by said sealing flap being formed by slots arranged on both sides and within the edge of the upper side such that said slots simultaneously delimit said removal opening, and an overlapping material of said packaging wrapper being bonded together on the upper side outside said slots and outside said removal opening, wherein for the temporary and repeatable sealing of the pouch, a pressure-sensitive adhesive is applied to an outer surface of said extension located beneath the sealing flap or to an inner surface of said sealing flap located above said extension such that corners of said sealing flap formed by said slots do not outwardly project in a closed state.

2. A packaging wrapper according to claim 1, wherein a heat-sealing lacquer is applied to the outer surface of said extension of the front side of said packaging wrapper located beneath said sealing flap or to the inner surface of said sealing flap located above said extension.

3. A packaging wrapper according to claim 2 wherein said packaging wrapper is printed and regions without print are provided on the upper side outside said slots in an area of bonding.

4. A packaging wrapper according to claim 3, wherein an adhesive strip provided with a pressure-sensitive adhesive is attached to said sealing flap and projects over said sealing flap.

5. A packaging wrapper according to claim 4, wherein said pressure-sensitive adhesive is applied essentially over the entire surface area of the inner surface of the sealing flap above the extension of the front side of the packaging wrapper.

6. A packaging wrapper according to claim 5, wherein said region covered by said pressure-sensitive adhesive is reduced in the vicinity of said adhesive strip.

7. A packaging wrapper according to claim 6, wherein said reduced region is concavely rounded toward the free edge of said sealing flap.

8. A packaging wrapper according to claim 4, wherein said applied pressure applied in stripes or dots or in a pattern in the area of the upper side of said packaging wrapper.

9. A packaging wrapper according to claim 3, wherein said pressure-sensitive adhesive is applied essentially over the entire surface area of the inner surface of the sealing flap above the extension of the front side of the packaging wrapper.

10. A packaging wrapper according to claim 3, wherein said applied pressure-sensitive adhesive is applied in stripes or dots or in a pattern in the area of the upper side of said packaging wrapper.

11. A packaging wrapper according to claim 2, wherein an adhesive strip provided with a pressure-sensitive adhesive is attached to said sealing flap and projects over said sealing flap.

12. A packaging wrapper according to claim 11, wherein said pressure-sensitive adhesive is applied essentially over the entire surface area of the inner surface of the sealing flap above the extension of the front side of the packaging wrapper.

13. A packaging wrapper according to claim 12, wherein said region covered by said pressure-sensitive adhesive is reduced in the vicinity of said adhesive strip.

14. A packaging wrapper according to claim 13, wherein said reduced region is concavely rounded toward the free edge of said sealing flap.

15. A packaging wrapper according to claim 11, wherein said applied pressure-sensitive adhesive is applied in stripes or dots or in a pattern in the area of the upper side of said packaging wrapper.

16. A packaging, wrapper according claim 2, wherein said pressure-sensitive adhesive is applied essentially over the entire surface area of the inner surface of the sealing flap above the extension of the front side of the packaging wrapper.

17. A packaging, wrapper according claim 2, wherein said pressure-sensitive adhesive is applied in striped or dots or in a pattern in the area of the upper side of said packaging wrapper.

18. A packaging wrapper according to claim 1 wherein said packaging wrapper is printed and regions without print are provided on the upper side outside said slots in an area of bonding.

19. A packaging wrapper according to claim 18, wherein an adhesive strip provided with a pressure-sensitive adhesive is attached to said sealing flap and projects over said sealing flap.

20. A packaging wrapper according to claim 19, wherein said pressure-sensitive adhesive is applied essentially over the entire surface area of the inner surface of the sealing flap above the extension of the front side of the packaging wrapper.

21. A packaging wrapper according to claim 20, wherein said region covered by said pressure-sensitive adhesive is reduced in the vicinity of said adhesive strip.

22. A packaging wrapper according to claim 21, wherein said reduced region is concavely rounded toward the free edge of said sealing flap.

23. A packaging wrapper according to claim 19, wherein said applied pressure-sensitive adhesive is applied in stripes or dots or in a pattern in the area of the upper side of said packaging wrapper.

24. A packaging wrapper according to claim 18, wherein said pressure-sensitive adhesive is applied essentially over the entire surface area of the inner surface of the sealing flap above the extension of the front side of the packaging wrapper.

25. A packaging wrapper according to claim 18, wherein said applied pressure-sensitive adhesive is applied in striped or dots or in a pattern in the area of the upper side of said packaging wrapper.

26. A packaging wrapper according to claim 1, wherein an adhesive strip provided with a pressure-sensitive adhesive is attached to said sealing flap and projects over said sealing flap.

27. A packaging wrapper according to claim 26, wherein said pressure-sensitive adhesive is applied essentially over the entire surface area of the inner surface of the sealing flap above the extension of the front side of the packaging wrapper.

28. A packaging wrapper according to claim 27, wherein said region covered by said pressure-sensitive adhesive is reduced in the vicinity of said adhesive strip.

29. A packaging wrapper according to claim 28, wherein said reduced region is concavely rounded toward the free edge of said sealing flap.

30. A packaging wrapper according to claim 21, wherein said applied pressure-sensitive adhesive is applied in stripes of dots or in a pattern in the area of the upper side of said packaging wrapper.

31. A packaging wrapper according to claim 1, wherein said pressure-sensitive adhesive is applied essentially over the entire surface area of the inner surface of the sealing flap above the extension of the front side of the packaging wrapper.

32. A packaging wrapper according to claim 1, wherein said applied pressure-sensitive adhesive is applied in striped or dots or in a pattern in the area of the upper side of said packaging wrapper.

33. A packaging wrapper comprising:

a sealing flap that at least partially overlaps a removal opening, the sealing flap being formed by an extension of a rear side of the packaging wrapper and defined by slots located on both sides of the sealing flap;

an extension of a front side of the packaging wrapper, the extension of the front side of the packaging being defined by slots arranged on both sides of the extension, wherein the extension of a front side of the packaging wrapper is at least partially overlapped by the sealing flap;

an overlapping material being bonded together outside the slots and outside the removal opening; and a pressure-sensitive adhesive effective for temporary and repeatable sealing of the packaging wrapper, the pressure-sensitive disposed on an outer surface of the extension of the front side of the packaging wrapper beneath the sealing flap, or to an inner surface of the sealing flap above the extension of the front side of the packaging wrapper.

34. A packaging wrapper comprising:

a sealing flap that at least partially overlaps a removal opening, the sealing flap being formed by an extension of a rear side of the packaging wrapper and defined by slots located on both sides of the sealing flap;

an extension of a front side of the packaging wrapper, the extension of the front side of the packaging being defined by slots arranged on both sides of the extension, wherein the extension of a front side of the packaging wrapper is at least partially overlapped by the sealing flap;

an overlapping material being bonded together outside the slots and outside the removal opening; and wherein a heat-sealing lacquer is applied to the outer surface of said extension of the front side of said packaging wrapper located beneath said sealing flap or to the inner surface of said sealing flap located above said extension.

35. A packaging wrapper comprising:

a sealing flap that at least partially overlaps a removal opening, the sealing flap being formed by an extension of a rear side of the packaging wrapper and defined by slots located-on both sides of the sealing flap;

an extension of a front side of the packaging wrapper, the extension of the front side of the packaging being defined by slots arranged on both sides of the extension, wherein the extension of a front side of the packaging wrapper is at least partially overlapped by the sealing flap;

an overlapping material being bonded together outside the slots and outside the removal opening; and a pressure-sensitive adhesive effective for temporary and repeatable sealing of the packaging wrapper, the pressure-sensitive disposed on an outer surface of the extension of the front side of the packaging wrapper beneath the sealing flap, or to an inner surface of the sealing flap above the extension of the front side of the packaging wrapper, wherein said packaging wrapper is printed and regions without print are provided on the upper side outside said slots in an area of bonding.

* * * * *